US007217154B2

(12) United States Patent
Harwath

(10) Patent No.: US 7,217,154 B2
(45) Date of Patent: May 15, 2007

(54) CONNECTOR WITH OUTER CONDUCTOR AXIAL COMPRESSION CONNECTION AND METHOD OF MANUFACTURE

(75) Inventor: Frank A Harwath, Naperville, IL (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 11/163,441

(22) Filed: Oct. 19, 2005

(65) Prior Publication Data

US 2007/0087626 A1 Apr. 19, 2007

(51) Int. Cl.
*H01R 9/05* (2006.01)

(52) U.S. Cl. ..... 439/578

(58) Field of Classification Search ..... 439/578, 439/583, 580–585, 579; 174/88 C; 280/1
See application file for complete search history.

(56) References Cited

U.S. PATENT DOCUMENTS

| | | | | |
|---|---|---|---|---|
| 4,408,822 | A | 10/1983 | Nikitas | |
| 4,687,272 | A | 8/1987 | Spinner et al. | |
| 4,746,305 | A * | 5/1988 | Nomura | 439/319 |
| 5,137,471 | A | 8/1992 | Verespej et al. | |
| 5,154,636 | A | 10/1992 | Vaccaro et al. | |
| 5,284,449 | A | 2/1994 | Vaccaro | |
| 5,295,864 | A | 3/1994 | Birch et al. | |
| 5,877,452 | A * | 3/1999 | McConnell | 174/88 C |
| 5,938,474 | A * | 8/1999 | Nelson | 439/583 |
| 6,120,306 | A | 9/2000 | Evans | |
| 6,386,915 | B1 | 5/2002 | Nelson | |
| 6,425,782 | B1 | 7/2002 | Holland | |
| 6,471,545 | B1 * | 10/2002 | Hosler, Sr. | 439/585 |
| 6,607,398 | B2 * | 8/2003 | Henningsen | 439/578 |
| 6,939,169 | B2 | 9/2005 | Islam et al. | |
| 2004/0077215 | A1 | 4/2004 | Palinkas | |
| 2004/0150947 | A1 | 8/2004 | Tang | |
| 2005/0159044 | A1 | 7/2005 | Harwath | |
| 2005/0181652 | A1 | 8/2005 | Montena | |

FOREIGN PATENT DOCUMENTS

| | | |
|---|---|---|
| DE | 2221936 | 11/1973 |

* cited by examiner

*Primary Examiner*—Alexander Gilman
(74) *Attorney, Agent, or Firm*—Babcock IP, PLLC

(57) ABSTRACT

An electrical connector for a coaxial cable with a solid outer conductor, the connector in combination with a cable and a method of manufacturing. The electrical connector having a connector body with a bore between a connector end and a cable end. The bore having an inner diameter shoulder at the cable end. A cylindrical sleeve positioned in the bore abutting the inner diameter shoulder. An annular groove open to the cable end, between the cylindrical sleeve and the cable end of the connector body. The annular groove dimensioned to receive an end of the solid outer conductor.

12 Claims, 4 Drawing Sheets

CONNECTOR WITH OUTER CONDUCTOR AXIAL COMPRESSION CONNECTION AND METHOD OF MANUFACTURE

BACKGROUND OF THE INVENTION

1. Field of the Invention

The invention relates to connectors for coaxial cable. More particularly the invention relates to cost effective connectors adapted for interconnection with annular corrugated coaxial cable via axial compression.

2. Description of Related Art

Transmission line cables employing solid outer conductors have improved performance compared to cables with other types of outer conductors such as metallic braid, foil, etc. Solid outer conductor coaxial cables are available in various forms such as smooth wall, annular corrugated, and helical corrugated. Each of the various forms typically requires a connector solution dedicated to the specific type of solid outer conductor.

Annular corrugated cable is flexible and has improved resistance to water infiltration. Annular corrugated coaxial cables are typically terminated using connectors that incorporate a mechanical clamp between the connector and the lip of the outer conductor. The mechanical clamp assemblies are relatively expensive, frequently requiring complex manufacturing operations, precision threaded mating surfaces and or multiple sealing gaskets.

An inexpensive alternative to mechanical clamp connectors is soldered connectors. Prior soldered connectors create an interconnection that is difficult to prepare with consistent quality and even when optimally prepared results in an interconnection with limited mechanical strength. Further, heat from the soldering process may damage cable dielectric and or sheathing material.

Another inexpensive alternative is interconnection by compression. "Crimping" is understood within the connector art to be a form of compression where the compressive force is applied in a radial direction. A wire is inserted within the connector body and a crimp die, for example a hand held crimp tool, applies radial compressive force. The crimp die compresses the connector body around the solid core at high pressure. The connector body is permanently deformed to conform to the solid core of the wire, resulting in a strong mechanical and electrical bond. The high residual stress, in the material of the connector body, keeps the contact resistance low and stable. The strength of the bond in tension approaches the ultimate tensile strength of the wire. However, because of the different diameter before and after crimping has been applied, the radial acting compression surfaces cannot be arranged to simultaneously contact 360 degrees of the crimp surface, resulting in uneven application of the crimp force and less than uniform deformation of the connector body, creating issues with environmental sealing of the connector and cable interface.

Crimping braided outer conductors is more problematic. To prevent deformation of the outer conductors in relation to the center conductor, a support sleeve of one form or another may be used. Usually, the braid is captured in a layer between a tubular outer ferrule and the connector body. This crimp is not considered highly reliable. There are typically large voids in the interface allowing for corrosive degradation of the contact surfaces. The mechanical pull strength of the joint does not approach the strength of the wire. Finally, the connection allows relative movement between all 3 components, which results in a very poor, noisy electrical connection.

Due to the corrugation patterns used in solid outer conductor cables, tubular support sleeves would require a sleeve that significantly changes the internal dimensions of the cable, causing an RF impedance discontinuity. To prevent deformation of a solid outer conductor, without using an internal sleeve, an external mating sleeve adapted to key to the corrugation pattern has been used in a crimp configuration. However, the level of crimp force applicable before the outer conductor deforms is limited, thereby limiting the strength of the resulting interconnection.

The connector bodies are typically machined from stock material and or castings that are then further machined. The numerous milling and or turning operations required to manufacture the connector body and associated components comprising the connector assembly are a significant contributor to the overall manufacturing cost.

Competition within the coaxial cable and connector industry has focused attention upon reducing manufacturing, materials and installation costs. Also, strong, environmentally sealed interconnections are desirable for many applications.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The present invention applies axial, rather than radial, mechanical compression forces to make a circumferential inward deformation at the cable end of a connector body according to the invention. The inward deformation operating to interconnect the connector and the outer conductor of a coaxial cable. Thixotropic metal molding techniques may be applied to form the connector body with significantly reduced manufacturing costs.

Figure 1:
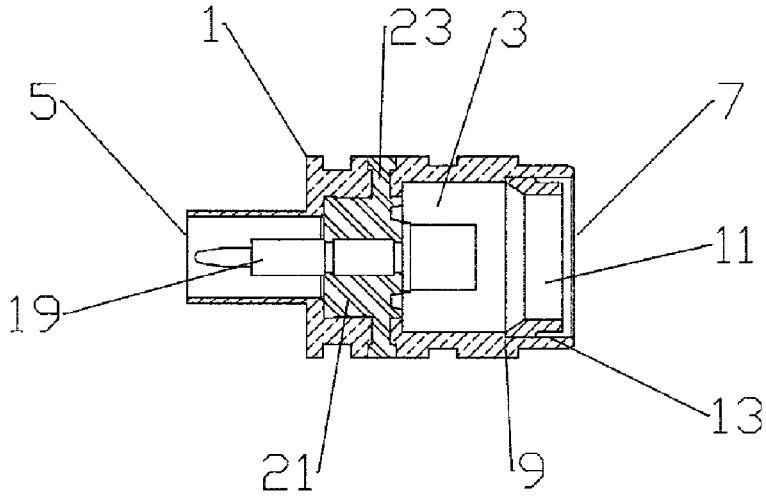
FIG. 1 is a schematic partial cross section side view of a first embodiment of a connector according to the invention.

First and second exemplary embodiments of the invention are described with reference to FIGS. 1–8. As shown in FIG. 1, a connector body 1 has a bore 3 between a connector end 5 and a cable end 7. At the cable end 7, an inner diameter shoulder 9 is dimensioned to receive a cylindrical sleeve 11. An annular groove 13 open to the cable end 7 is formed between the cylindrical sleeve 11 and the connector body 1. The annular groove 13 may be formed, for example, by an outer diameter shoulder 15 formed in the cable end 7 of the cylindrical sleeve 11. Alternatively, an inner diameter step may be formed at the inner diameter of the connector body 1 cable end 7, simplifying manufacture of the cylindrical sleeve 11.

The annular groove 13 may be dimensioned to receive an end of the solid outer conductor 15 at the corrugation peak diameter, if any. To minimize disruption of electrical characteristics resulting from uniformity of the spacing between the inner conductor 17 and the outer conductor 15, the cylindrical sleeve 11 may be dimensioned to have an inner diameter that is substantially equal to or greater than that of the outer conductor 15 corrugation bottom diameter, if any.

In some connector interface configurations, such as Type F, the inner conductor 17 of the cable passes through the bore as part of the connector interface. In others, a center contact 19 may be positioned coaxial within the bore 3 by an insulator 21. The insulator 21 may be formed in situ using plastic injection molding whereby the insulator 21 material is injected through aperture(s) 23 in the connector body 1, filling the space between the center contact 19 and the connector body 1 within the bore 3 to support the center contact 19 and form an environmental seal between the connector end 5 and the cable end 7. For ease of inventory, storage and delivery the cylindrical sleeve 11 may be press fit into the inner diameter shoulder 15 to produce a unitary component ready for connection to a desired cable. The connector end 5 of the connector body 1 is demonstrated herein adapted for use in a standardized Type-N connector interface configuration, coupling nut omitted for clarity. One skilled in the art will recognize that any desired standard or proprietary connector interface configuration may be applied to the connector end.

Figure 2:
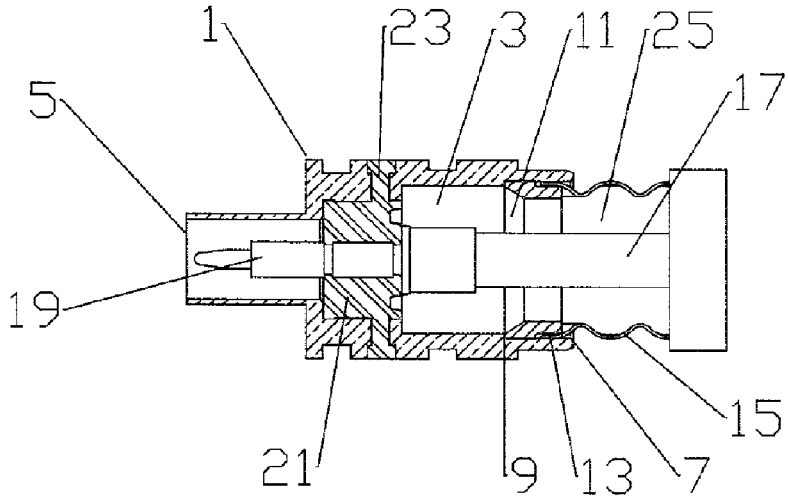
FIG. 2 is a schematic partial cross section side view of FIG. 1, with a cable having an annular corrugated outer conductor positioned for connection via axial compression.

An example of an annular corrugated coaxial transmission line cable suitable for use with a connector according to the invention is LDF4 manufactured by the assignee of the invention, Andrew Corporation of Orland Park, Ill. The cable has an outer conductor 15 with annular corrugations and an inner conductor 17 surrounded a dielectric. To permanently connect the cable to the connector, the cable end is prepared such that a corrugation peak appears at the cable end, any outer protective sheath of the coaxial cable is stripped back and the inner conductor 17 extends a predetermined distance from the end of the outer conductor 15. As shown in FIG. 2, the outer conductor 15 cable end is inserted into the annular groove 13. As the outer conductor 15 is inserted into the annular groove 13, the inner conductor 17 also seats into, for example, spring finger(s) or other contact mechanism of the center contact 19.

Figure 3:
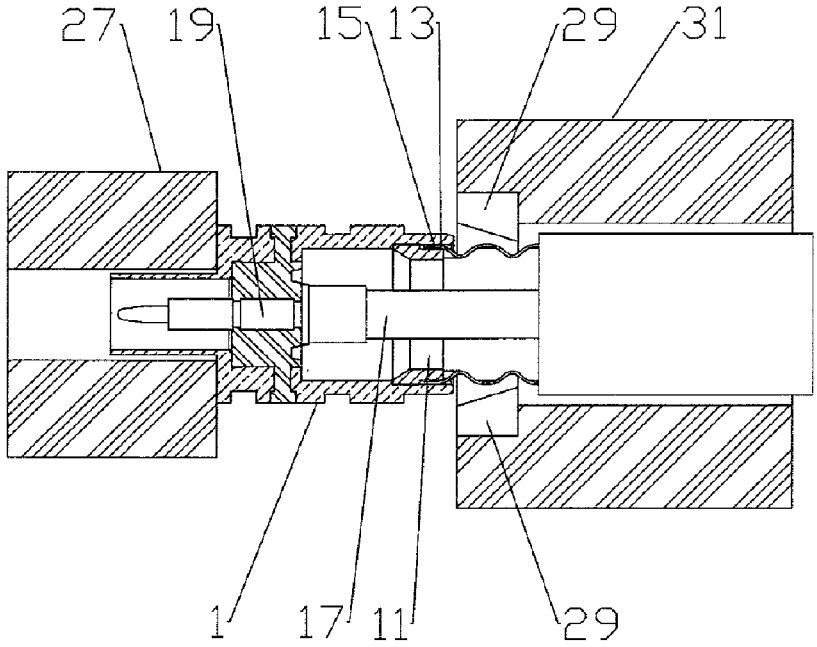
FIG. 3 is a schematic partial cross section side view of FIG. 2, seated in a nest and segmented die(s) before application of axial compression to interconnect the cable and connector.
Figure 4:
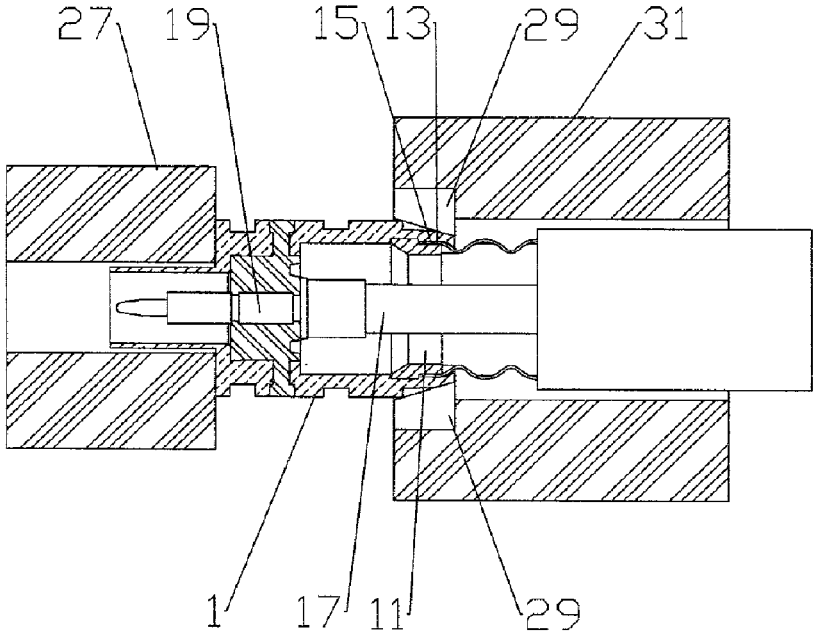
FIG. 4 is a schematic partial cross section side view of FIG. 3, after application of axial compression to interconnect the cable and connector.
Figure 5:
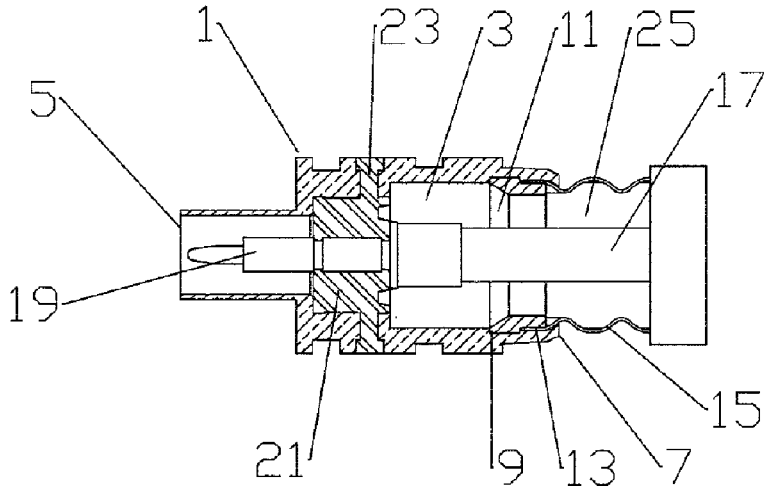
FIG. 5 is a schematic partial cross section side view FIG. 2, after application of axial compression to interconnect the cable and connector.

As shown for example in FIG. 3, to interconnect the connector body 1 and cable, the connector end 5 of the connector body 1 may be positioned against a connector end nest 27 against which axial compression force, along the longitudinal axis of the connector body 1 and cable, is applied between the connector end 5 and the cable end 7 of the connector body 1. The cable end 7 of the connector body 1 is contacted by the angled surface(s) 28 of two or more segmented die(s) 29. To simplify segmented die 29 setup and removal after the axial compression force application, the segmented die(s) 29 may be adapted to be carried by a die nest 31. After the connector body 1 and cable are positioned against the connector end nest 27 and segmented die(s) 29 are placed about the connector body 1 and cable, the connector end nest 27 and segmented die(s) 29 are moved axially relative to each other whereby the angled surface(s) 28 act upon the cable end 7 of the connector body 1 to create a uniform circumferential inward deformation, as shown in FIGS. 4 and 5, securing the connector body 1 to the outer conductor 15 and thereby the cable to the connector body 1.

Preferably, as a result of the application of the axial compression, the cable end 7 of the connector body 1 is uniformly deformed to a diameter less than the annular groove 13, creating a mechanical block against separation of the outer conductor 15 out of the annular groove 13 and away from the connector body 1. To allow the cable end 7 of the connector body 1 to extend inward under axial compression to form the mechanical block, the cable end 7 of the connector body 1 may be dimensioned to extend towards the cable end 7 farther than the cylindrical sleeve 13 by at least twice the thickness of the outer conductor 15.

Figure 6:
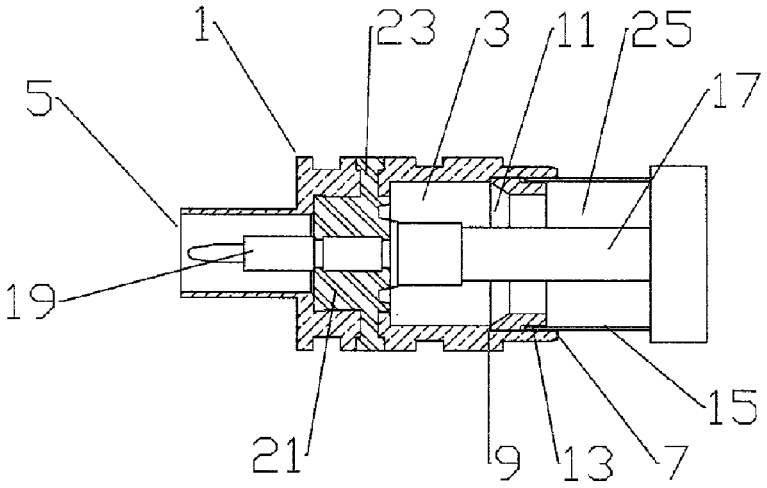
FIG. 6 is a schematic partial cross section side view of FIG. 1, with a cable having a straight wall outer conductor positioned for connection via axial compression.
Figure 7:
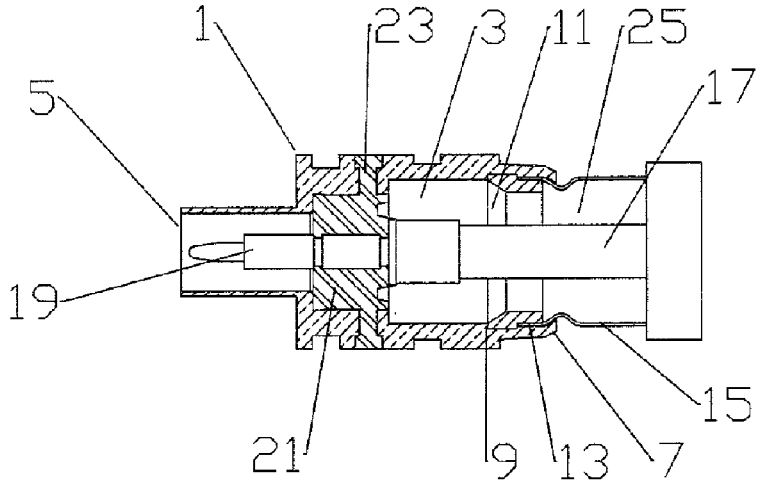
FIG. 7 is a schematic partial cross section side view of FIG. 6 after application of axial compression to interconnect the cable and connector.

As shown in FIGS. 6 and 7, the same connector body 1 may also be used with straight wall outer conductor 15 cable. In this case, annular deformation also occurs with respect to the outer conductor 15.

Figure 8:
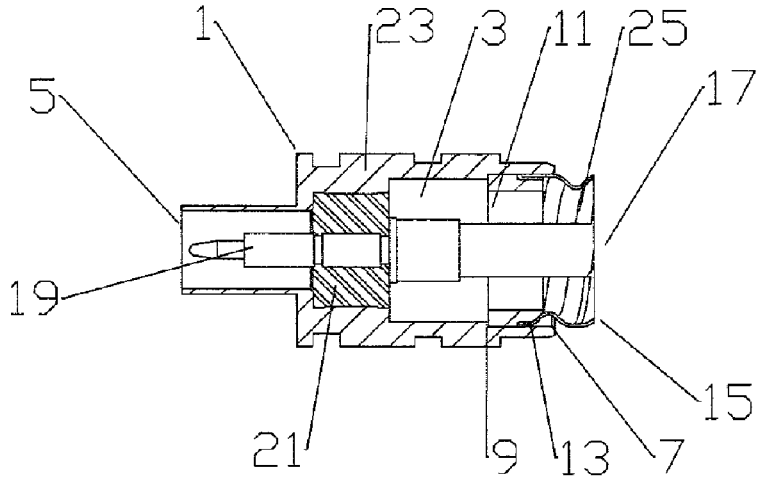
FIG. 8 is a schematic partial cross section side view of a second embodiment of a connector according to the invention, with a cable having a helical corrugated outer conductor positioned for connection via axial compression.

In a second embodiment, as shown in FIG. 8, the cylindrical sleeve 11 may be formed with a notch(s) 33 dimensioned to receive the leading edge of corrugation(s) of a helical corrugated outer conductor 15 cable. Thereby, a single connector body 1 according to the invention may be coupled to straight, annular corrugated or helical corrugated solid outer conductor 15 coaxial cable of similar diameter. One skilled in the art will recognize that a connector according to the invention may be applied to any outer conductor corrugation for which the connector body 1 and or cylindrical sleeve 11 are adapted to form an annular groove 13 which mates with the end profile of the desired outer conductor 15.

The axial movement of the dies and or nest during application of the axial compression force allows a contiguous 360 degrees of radial contact upon the cable end 7 of the connector body 1, simultaneously. Therefore, the inward deformation of the cable end 7 of the connector body 1 is uniform. This creates a void free interconnection with high strength; very low and stable contact resistance, low intermodulation distortion and a high level of mechanical interconnection reliability.

A first material of the connector body 1 is selected to have a rigidity characteristic that is suitable for deformation. Similarly, a second material of the cylindrical sleeve 11 is selected to have a greater rigidity characteristic than that of the connector body 1 such that while the cable end of the connector body deforms into close retaining contact with the outer conductor 15 and cylindrical sleeve 11 beneath it under the axial compression, the cylindrical sleeve 11 does not, preventing collapse of the connector body 1 and or outer conductor 15 into the dielectric space of the cable. By selecting a suitable material thickness differential with respect to the rest of the connector body 1, the cable end 7 of the connector body 1 is configured to be the weakest area of the connector body 1. Thereby, when the connector body 1 is subjected to axial compression, the cable end 7 of the connector body 1 experiences stresses beyond an elastic limit and permanently deforms, without unacceptably deforming the rest of the connector body 1.

Applicant has recognized that a suitable first material is magnesium metal alloy and a highly advantageous method of forming the connector body 1 is via thixotropic magnesium alloy metal injection molding technology. By this method, a magnesium alloy is heated until it reaches a thixotropic state and is then injection molded, similar to plastic injection molding techniques. Thereby, a connector body 1 according to the invention may be cost effectively fabricated to high levels of manufacturing tolerance and in high volumes. The magnesium alloys used in thixotropic metal molding have suitable rigidity characteristics and also have the benefit of being light in weight.

The invention provides a cost effective connector and cable interconnection with a minimum number of separate components, materials cost and required manufacturing operations that can be used with cables having any desired outer conductor corrugation. Further, the connector and cable interconnection according to the invention has improved electrical and mechanical properties. Installation of the connector onto the cable may be reliably achieved with a minimum of time and required assembly operations.

Table of Parts

| | |
|---|---|
| 1 | connector body |
| 3 | bore |
| 5 | connector end |
| 7 | cable end |
| 9 | inner diameter shoulder |
| 11 | cylindrical sleeve |
| 13 | annular groove |
| 15 | outer conductor |
| 17 | inner conductor |
| 19 | center contact |
| 21 | insulator |
| 23 | aperture |
| 25 | dielectric |
| 27 | connector end nest |
| 28 | angled surface |
| 29 | segmented die |
| 31 | die nest |
| 33 | notch |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An electrical connector for a coaxial cable with a solid outer conductor comprising:

a connector body with a bore between a connector end and a cable end; the bore having an inner diameter shoulder at the cable end;

a cylindrical sleeve positioned in the bore abutting the inner diameter shoulder;

an annular groove open to the cable end, between the cylindrical sleeve and the cable end of the connector body; the annular groove dimensioned to receive an end of the solid outer conductor; and the cylindrical sleeve has a sleeve inner diameter substantially equal to a corrugation bottom diameter of the outer conductor.

2. The connector of claim 1, wherein the cylindrical sleeve has a notch(s) dimensioned to receive a lead helical corrugation(s) of the end of the solid outer conductor.

3. The connector of claim 1, wherein the connector body extends toward the cable end farther than the cylindrical sleeve by greater than twice a thickness of the solid outer conductor.

4. The connector of claim 1, further including a center contact supported coaxial within the bore by an insulator.

5. The connector of claim 1, wherein the cylindrical sleeve is press fit into the inner diameter shoulder.

6. The connector of claim 1, wherein the annular groove is formed between the cylindrical sleeve and the cable end of the connector body by an outer diameter step in the cable end of the cylindrical sleeve.

7. The connector of claim 1, wherein the annular groove is formed between the cylindrical sleeve and the cable end of the connector body by an inner diameter step in the cable end of the connector body.

8. The connector of claim 1, wherein the cylindrical sleeve is formed from a first material having a greater rigidity characteristic than a second material of the connector body.

9. The connector of claim 8, wherein the second material is a magnesium alloy.

10. The connector of claim 1, further including a connector interface at the connector end.

11. A connector in combination with a coaxial cable having a solid outer conductor, comprising:

a connector body with a bore between a connector end and a cable end; the bore having an inner diameter shoulder at the cable end;

a cylindrical sleeve positioned in the bore abutting the inner diameter annular shoulder;

an annular groove open to the cable end between the cable body and the cylindrical sleeve; the annular groove dimensioned to receive an end of the solid outer conductor;

the end of the solid outer conductor retained in the annular groove by inward deformation of the cable end of the connector body; and the cylindrical sleeve has a sleeve inner diameter substantially equal to a corrugation bottom diameter of the outer conductor.

12. The apparatus of claim 11, wherein the inward deformation of the cable end of the connector body is applied until the cable end of the connector body has a diameter less than an inner diameter of the annular groove.

* * * * *